US005226648A

United States Patent [19]

Nogami

[11] Patent Number: 5,226,648

[45] Date of Patent: Jul. 13, 1993

[54] BOWLING APPARATUS WITH AUTOMATIC DETECTING FUNCTION FOR REMAINING PINS

[75] Inventor: Osamu Nogami, Tokyo, Japan

[73] Assignee: Kabushikikaisha Nogami Bowling Service, Tokyo, Japan

[21] Appl. No.: 824,650

[22] Filed: Jan. 23, 1992

[30] Foreign Application Priority Data

Jan. 24, 1991 [JP] Japan ..... 3-23987

[51] Int. Cl.[5] ..... A63D 5/04

[52] U.S. Cl. ..... 273/54 E

[58] Field of Search ..... 273/54 C, 54 E, 46

[56] References Cited

U.S. PATENT DOCUMENTS 3,847,394 11/1974 Logemann, Jr. et al. ..... 273/54 E
4,726,587 2/1988 Fitch ..... 273/54 E
4,827,412 5/1989 Form ..... 273/54 E X

FOREIGN PATENT DOCUMENTS 48-94541 12/1973 Japan .
49-96834 9/1974 Japan .
61-98272 5/1986 Japan .

*Primary Examiner*—William H. Grieb
*Attorney, Agent, or Firm*—Lowe, Price, LeBlanc & Becker

[57] ABSTRACT

Disclosed is an apparatus with an automatic detecting function for remaining pins in which the state of all of pins previous to the first bowl is photographed by a television camera from the upper front, image data of pins located at their fixed positions are set as reference data for each of the pins, and image data after the first bowl which are obtained by photographing the state of the remaining pins after the first bowl are compared with the reference data, to determine the presence or absence of the pins which are the objects to be measured for automatic scoring. It is the objective of the present invention to improve the accuracy in the measurement of the first pin. In the apparatus, the image data measurement points of the first pin are set at both sides of the head of the first pin, to thereby separate them from measurement points of the backward fifth pin.

1 Claim, 11 Drawing Sheets

BOWLING APPARATUS WITH AUTOMATIC DETECTING FUNCTION FOR REMAINING PINS

BACKGROUND OF THE INVENTION

1. Field of the Invention

The present invention relates to a bowling apparatus provided with a system for automatically detecting the number of the remaining pins in the bowling game apparatus.

2. Description of the Related Arts

The conventional prior arts incorporating an electro-optical apparatus for the identification of pins in the bowling game are as follows. For example, Japanese Unexamined Patent Publication (Kokai) Nos. 49-96834, 61-98272, and 48-94541 disclose an apparatus using a photodetector which responds to a light reflected from the upstanding pins, an apparatus utilizing image signals for the neck of each of pins, and an apparatus in which the bowling form of a bowler or the like is photographed by a television camera for displaying it on a monitor television, respectively.

These conventional apparatus, however, involve disadvantages in that a further specific illuminating device is required or the identification of the pins is often unstable due to the insufficiency of data used to determine the presence or absence of the pins. In order to overcome such problems, the applicant of the present invention has invented an apparatus in which the number of the remaining pins can be determined by digitally analyzing image data obtained by photographing the pins from the upper front with a television camera. FIG. 2 shows an image of the pins obtained by photographing them from the upper front.

In this case, as positions of image data for detecting the presence or absence of pins, some conventional examples use three points designated by reference numerals 5, 6 and 7 which are located at the head of a pin as shown in FIG. 3.

Providing that the number of the remaining pins is determined through the digital analysis of the image data obtained by photographing the pins from the upper front, the measurement points 8, 9, and 10 provided on the head of the first pin 1 adversely coincides with the neck of the fifth pin 2 due to the camera angle from the upper front. Accordingly, if the first pin is knocked down whereas the fifth pin remains standing, the measurement points of the first pin which would be otherwise located at the head thereof fall upon the neck of the fifth pin, which may cause an unstable recognition of the first pin, thus leading to an erroneous judgment.

Therefore, presently carried out is a method in which the measurement points signified by reference numerals 11, 12 and 13 in FIG. 5 are provided in the region closer to the bottom of the first pin, and the determination is performed based on the image data thereof. This method is rather effective, which may prevent the erroneous judgment to a certain extent. Nevertheless, if the first pin 1 is knocked down in the vicinity of the measurement positions of the first pin as shown in FIG. 6 when detecting the signals of the image data near the bottom the first pin, an erroneous detection may take place that the first pin remains standing at the predetermined position.

It is therefore an object of the present invention to provide an apparatus in which the image data obtained by photographing the pins from the upper front thereof are subjected to a digital analysis for the determination the number of the remaining pins, characterized in that the measurement positions of the image data are set so as to determine the present or absence of, in particular, the first pin without any fault.

SUMMARY OF THE INVENTION

In the bowling apparatus in accordance with the present invention, the state where all of pins stand is previously photographed from the upper front by a television camera under the same illumination as that during the games so that data such as hues and gray scales of the specific measurement points corresponding to the positions of the pins are set as the reference data for each of the pins, the state where the pins are rearranged after the first bowl is photographed by the same television camera, and the color data and/or gray scale data for the specific points obtained therefrom are compared with the reference color data and/or reference gray scale data to thereby determine the presence or absence of the pins which are the objects to be measured for automatically scoring, and characterized in that the measurement points of the first pin are provided at both sides of the head of the pin which are not allowed to coincide with the fifth pin in the image.

BRIEF DESCRIPTION OF THE DRAWINGS

The object and advantages of the present invention will become more apparent, when viewed in conjunction with the following drawings, in which.

DESCRIPTION OF THE PREFERRED EMBODIMENTS

Figure 7:
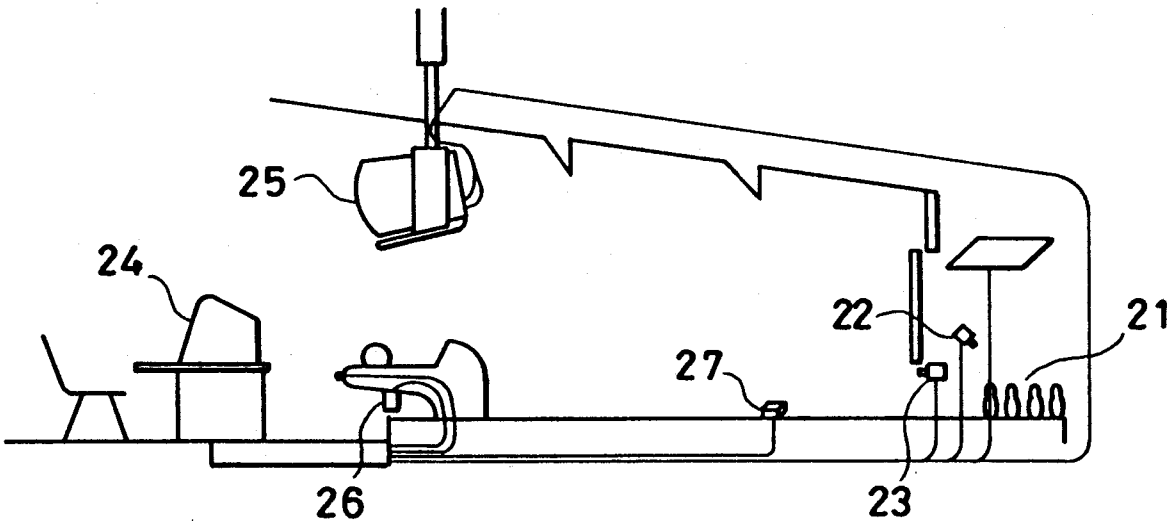
FIG. 7 shows the constitution of a lane section of the bowling apparatus provided with the pin detector in accordance with the present invention.

The action of the apparatus according to the present invention will now be described with reference to the accompanying drawings. FIG. 7 diagramatically shows the configuration of a lane section of a bowling apparatus provided with a pin detector in accordance with the present invention. The apparatus of the present invention includes at least a couple of television cameras. Bowling pins 21 are photographed by a television camera 22 for photographing the pins. A television camera 23 takes pictures of a bowler.

Pictures formed through the television camera 22 appear on a CRT (cathode-ray tube) 24 of a console table as well as a large-sized CRT 25 placed on the ceiling. These CRT's are also used to display video disk or television broadcasting pictures input from the other sources if necessary. In the apparatus embodying the present invention, the pictures of the pins photographed from diagonally upper front by the television camera 22 are projected on the CRT24,25 until the bowler appears on the lane. The appearance of the bowler onto the lane is detected by a bowler sensor 26, and the CRT's24,25 display the pictures from the television camera 23 for photographing the bowler. When a bowl rolled by the bowler is detected by a bowl passing sensor 27, the camera 22 is switched into the camera 22 for photographing the pins to project the action of pins on the CRT's24,25. Pins which have been knocked over are removed, and pictures of the remaining pins are imaged on the CRT's24, 25. These pictures are transmitted to a picture analyzing system to detect the number of the remaining pins. In the apparatus of the present invention, an automatic scoring can be performed on the basis of data about the number of the remaining pins, to thereby display the score on the CRT's24, 25.

In the case of a color television camera, image data from the television camera are converted into digital data corresponding to gradations for each color of RGB (red, green and blue). As for a monochrome television camera, image data are converted into digital data in response to the gradations. These digital data are recorded in a video RAM. With regard to the color television camera, when the image data are converted into digital data of 16 gradations for each color of RGB, each pixel or picture element can represent 4096 colors. An increase in the number of gradations will allow still finer distinctions of hues, but 4096 colors are practically enough for errorless distinction. It is desirable for the monochrome television camera to have a function to distinguish gray scales of 32 gradations or more since its data are restricted only to shades of gray between black and white.

Figure 1:
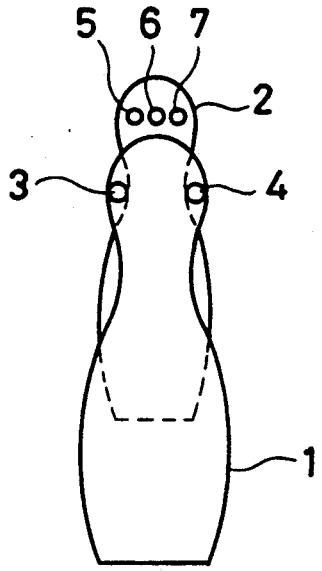
FIG. 1 shows points to be measured in the first and fifth pins according to the present invention.
Figure 2:
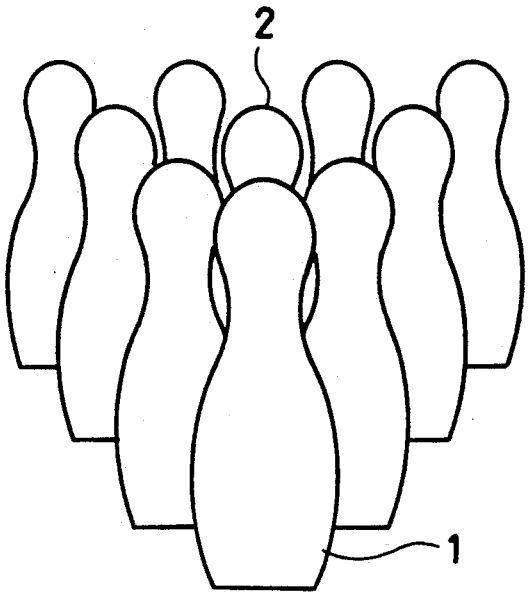
FIG. 2 is an explanatory drawing showing the state where ten pins are photographed according to the present invention.
Figure 3:
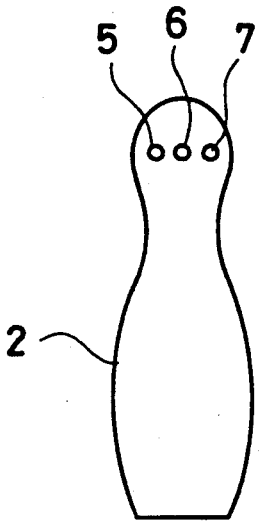
FIG. 3 shows points to be measured in a pin.

The presence or absence of each of pins is decided based on reference color data and/or reference gray scale data in video RAM coordinates which have been previously determined correspondingly to each pin, to thus carry out the measurement of the remaining pins. To obtain the reference color data and/or the reference gray scale data, the pins are photographed by a color television camera under the same illumination as that in playing games, to set hues or gray scales of the specific points corresponding to the positions of the pins. Taking into consideration a case where pins are displaced from their own positions, a plurality of measurement points may be provided within a predetermined region for each of the pins. FIG. 1 shows, by way of example, points to be measured of the first and fifth pins. Point 6 denotes an ordinary measurement point, while points 5 and 7 represent measurement points in view of the displacement of the pins.

Figure 4:
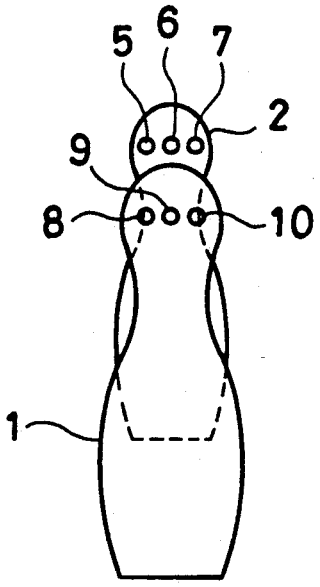
FIG. 4 is an explanatory drawing showing the positional relationship between the measurement points of the first pin and the fifth pin in the conventional detection of the presence or absence of the pins.
Figure 5:
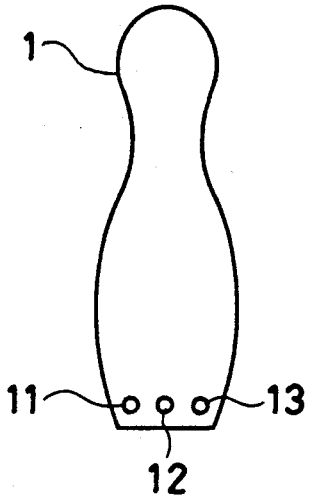
FIG. 5 is an explanatory drawing showing an example of the measurement points of the first pin in the conventional detection of the present or absence of the pins.
Figure 6:
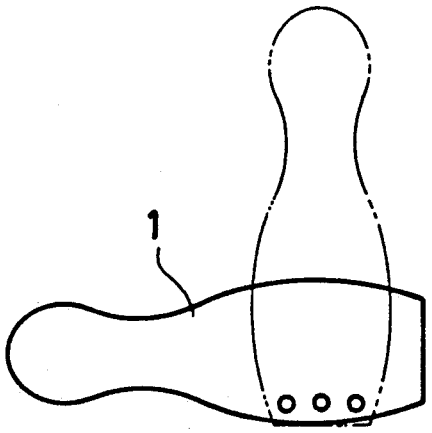
FIG. 6 is an explanatory drawing showing an example of the measurement of the first pin in the conventional detection of the present or absence of the pins.

FIG. 4 also shows measurement points of the first pin in accordance with the present invention. As apparent from FIG. 4, providing that the first pin is measured at the same measurement points as the other pins, the central measurement point 9 of the first pin coincides with the fifth pin, which brings about erroneous detection as if the first pin still stands even in the case where the first pin is knocked down but the fifth pin is not knocked down. It is empirically convinced that the probability is substantially zero that the knock down of the first pin will cause a parallel displacement of the fifth pin. Accordingly, the first pin should be provided with two measurement points at both sides of the head of the pin which are not allowed to coincide with the fifth pin as shown in FIG. 4.

The measurement is executed on the first to the tenth pins, in which it is judged that a pin is not present if the measured values of the pin are beyond the predetermined tolerance as compared with the previously determined color data or reference gray scale data. Even though the colors and/or gray scales of the pins are the same and the front pins are knocked down while the rear pins remains standing, the illumination confers slightly different hues and/or gray scales on the associated parts of the pins, thus making it possible to judge whether the pin is the object to be measured or not. This can be achieved only by the system according to the present invention having a function to distinguish a great variety of hues and/or gray scales. This feature entirely differs in principle from the conventional detecting system for the remaining pins using a certain light beam.

Instead of the previous setting, the reference data such as the reference color data and/or reference gray scale data may be derived from image data which is obtained by photographing the state where all of ten pins are standing prior to the first bowl. Thus, the alteration of the reference color data or reference gray scale data for each of bowls enables to cope with dirt of the pins or mixing of the different pins in colors.

Figure 8:
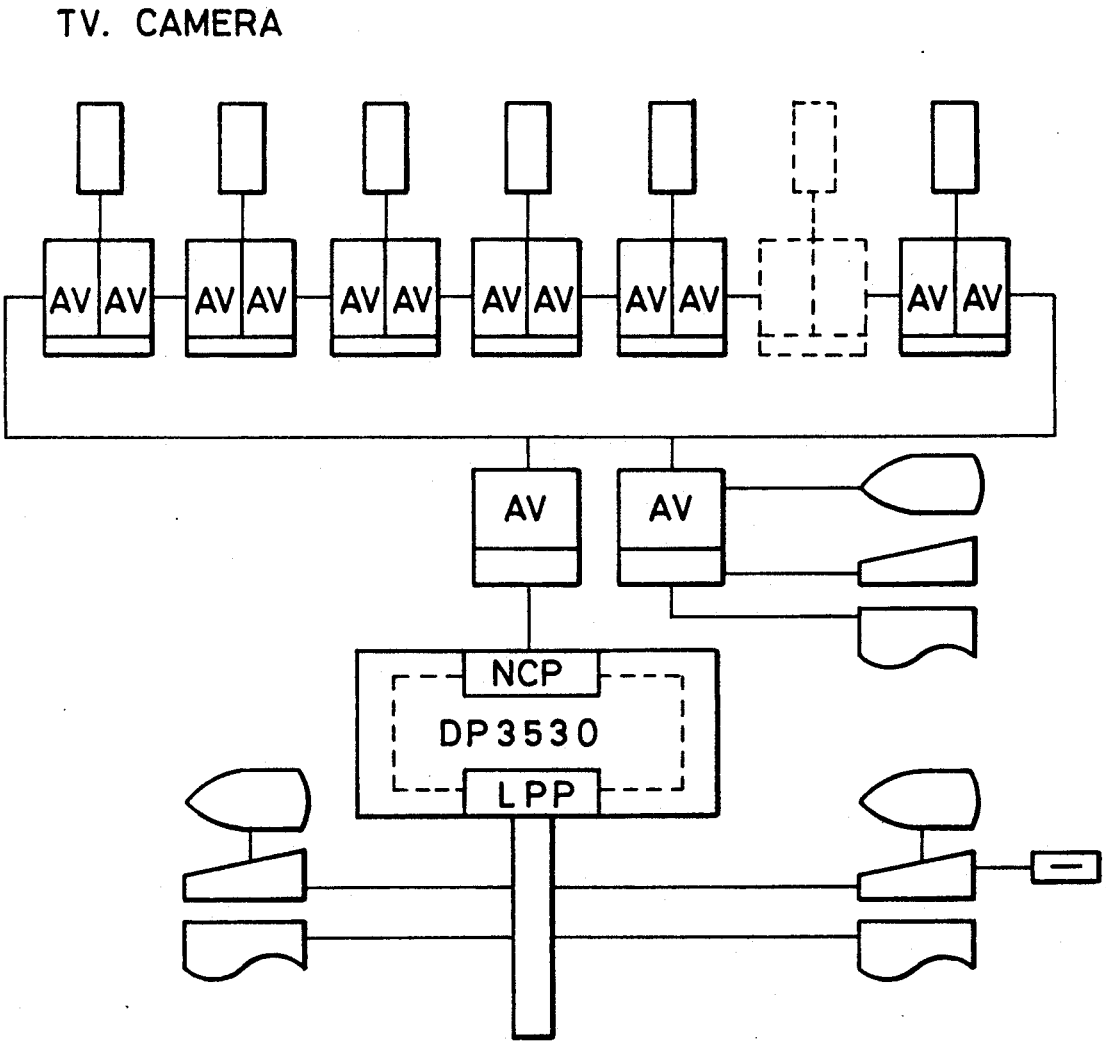
FIG. 8 shows a control system over the entire bowling alley provided with the bowling apparatus of the present invention.

An embodiment of the present invention will be described hereinafter with reference to the accompanying drawings. FIG. 8 shows a control system over the entire bowling alley incorporating the bowling apparatus of the present invention. Based on a picture from a television camera, the number of remaining pins is detected by means of an image processing computer provided on each of lanes. Data from each of the lanes are transmitted to an integrated data processing (IDP) unit.

Figure 9:
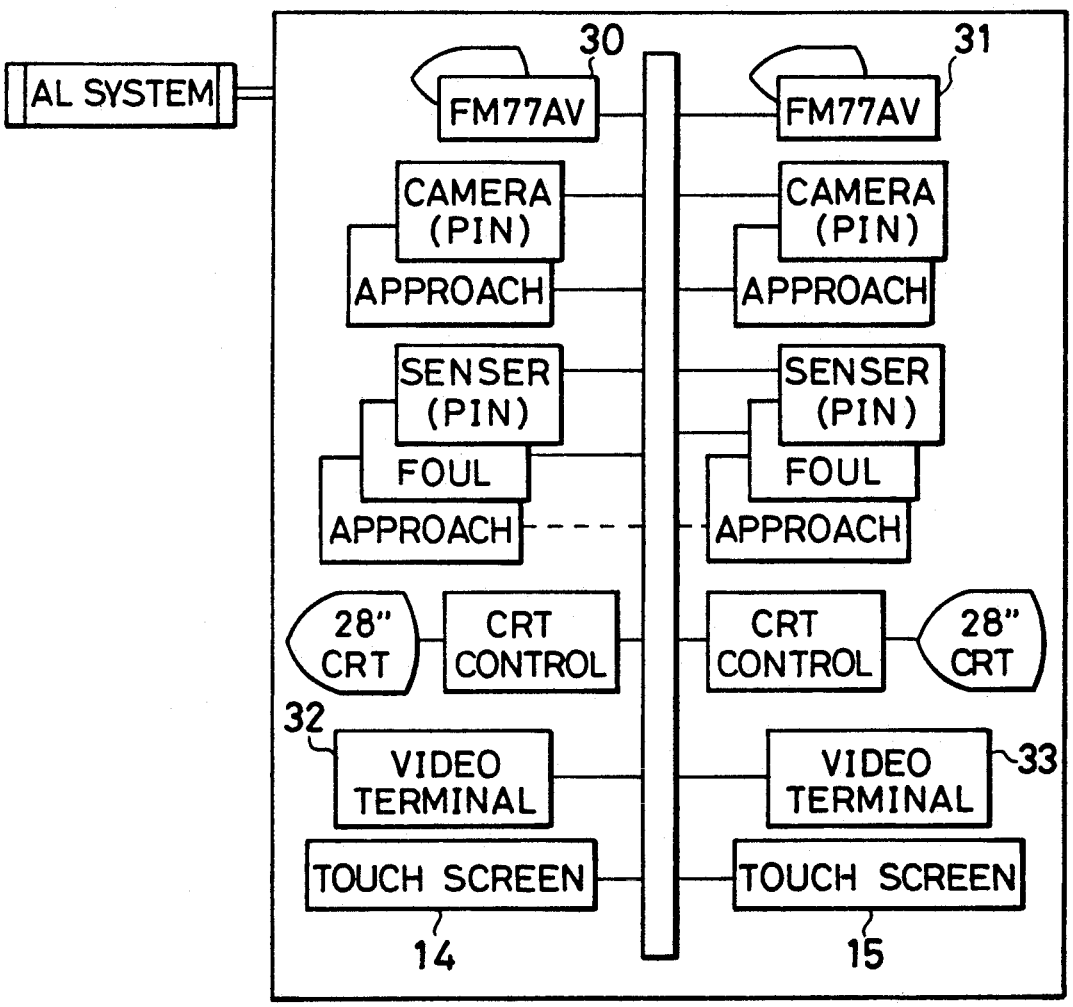
FIG. 9 shows a system provided on each of the lanes.

FIG. 9 partially shows a system disposed on each of the lanes. The image processing computers 30 and 31 are mounted for each of the lanes. Video terminals are used to record bowling forms or games with a VTR. In this apparatus, any required inputs are provided through touch screens 14 and 15 by players.

Figure 10:
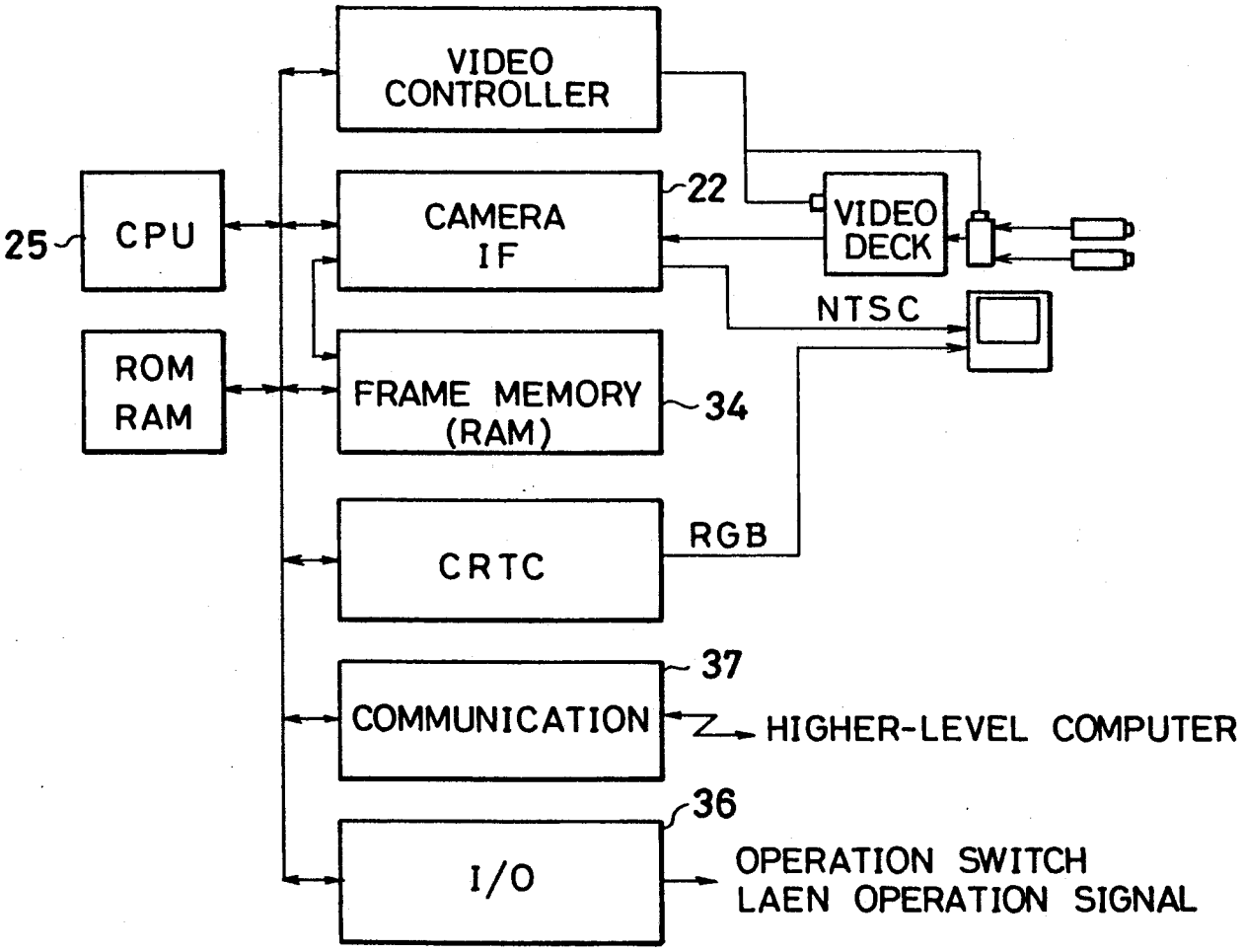
FIG. 10 shows a system provided on each of the lanes.

FIG. 10 illustrates a system disposed on each of the lanes. Pictures of pins transmitted from the television camera22 are digitalized and recorded in a video RAM34. A micro computer35 determines the presence or absence of the pins depending on the data within the video RAM, keeps score and displays it. When using a plurality of television cameras, output pictures are controlled based on signals transmitted from sensors through contacts and input/output boards36. Furthermore, the data of the score are transmitted to a host computer by way of a communication control board37 for the use in totalization in a bowling tournament or analyses of the bowlers' scores.

Figure 11:
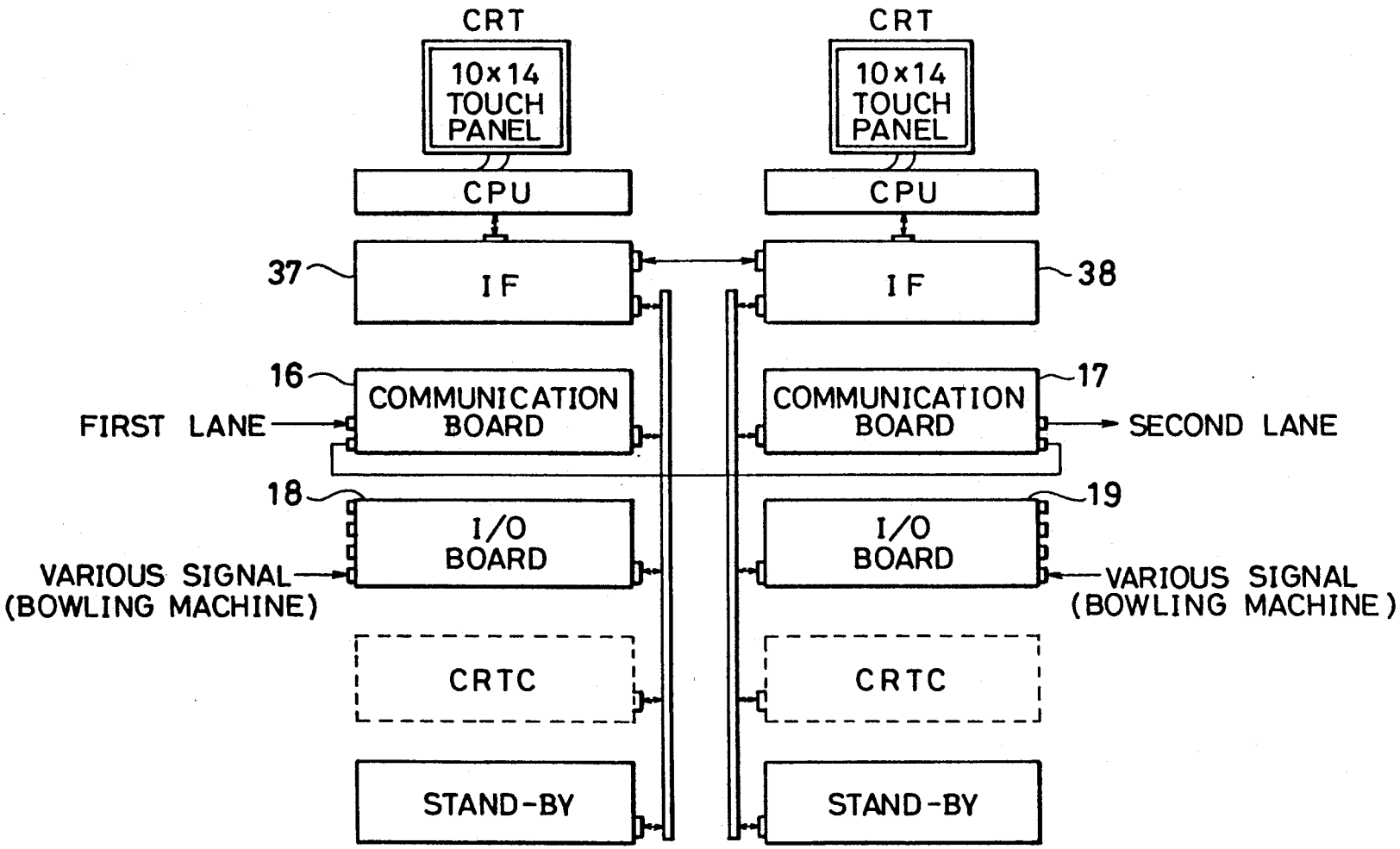
FIG. 11 shows a system provided on each of the lanes.
Figure 12:
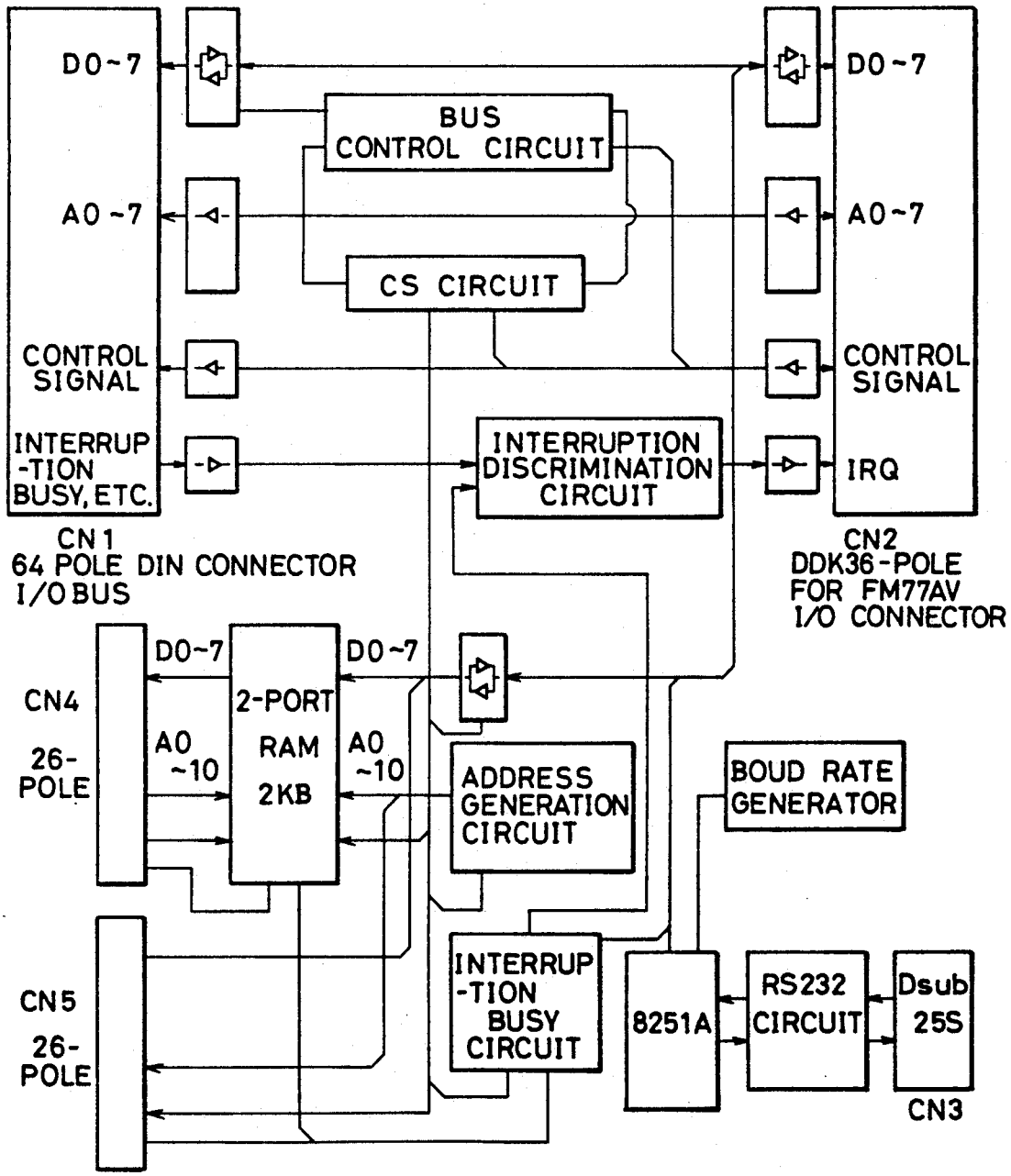
FIG. 12 is a block diagram of a communication board.
Figure 13:
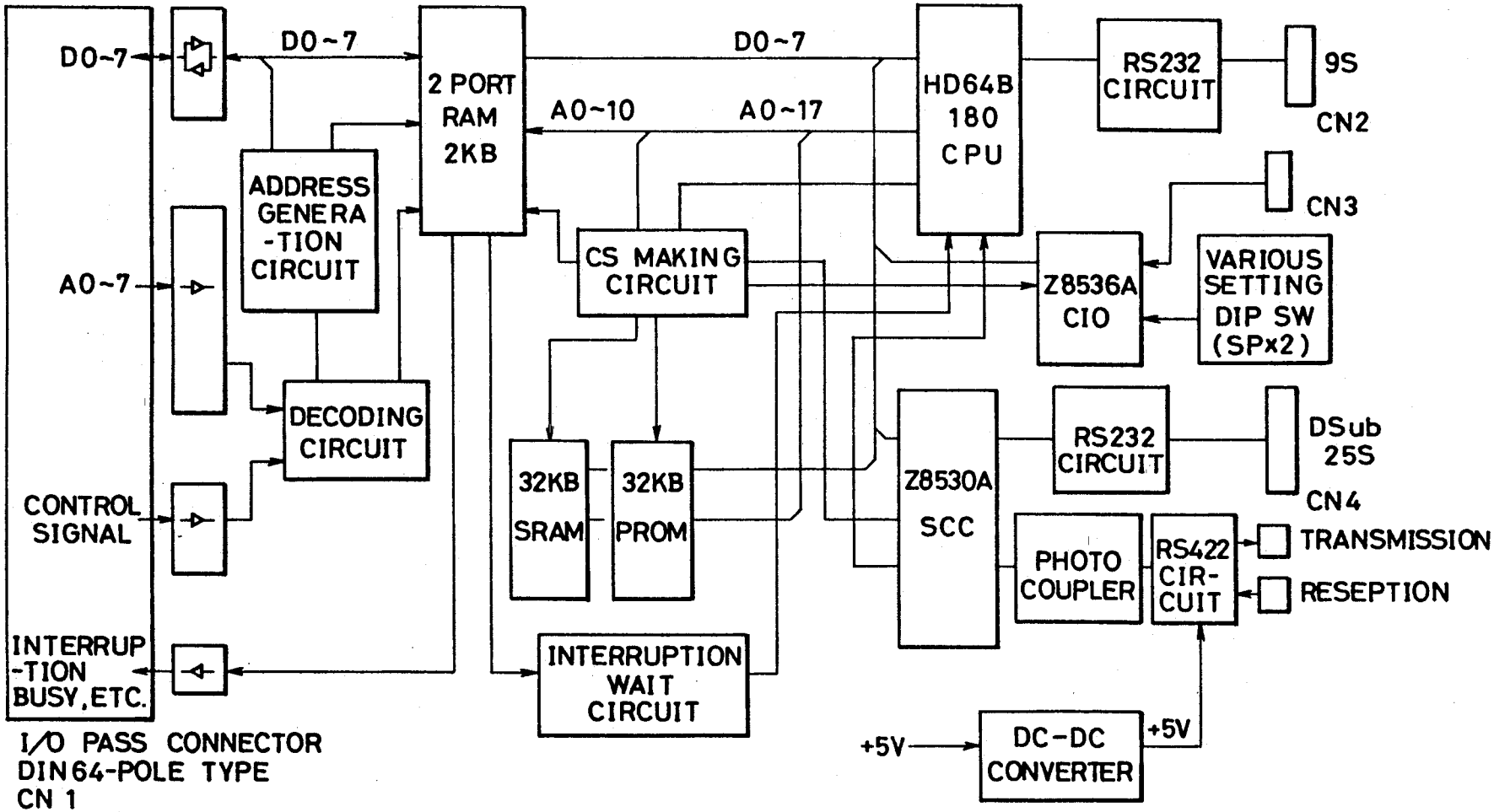
FIG. 13 is a block diagram of I/O board.
Figure 14:
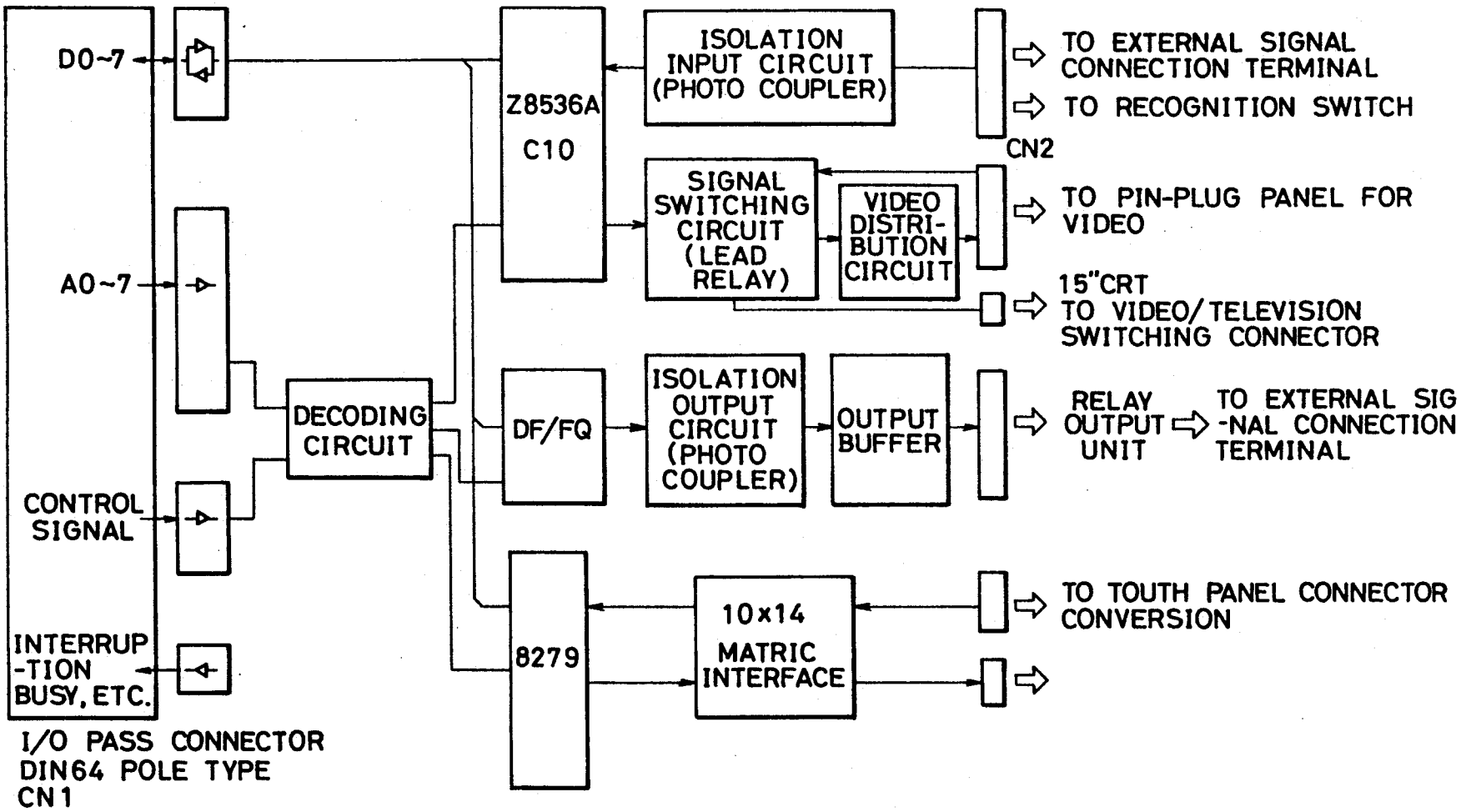
FIG. 14 is a block diagram of I/F board.

FIG. 11 shows in detail a part of a system provided on each of the lanes. The system of each lane is connected to the integrated processing unit via the communication board16,17. The system is further connected to a bowling machine through the I/O board18,19. FIG. 12 is a block diagram of the communication board, FIG. 13 is a block diagram of the I/O board18,19, and FIG. 14 is a block diagram of an IF board37,38.

According to the bowling apparatus of the present invention, the monitor television displays not only the score but also bowling forms or pin actions, thus enabling a distinct recognition of a pocket zone at the time of strike. It is also possible for the bowler to review his/her own bowling later by virtue of the VTR, which may contribute to the improvement in the skill of the players. In addition, since the automatic scoring is executed in accordance with the data of the pins displayed on the monitor television, there is no need for further provision of specific scoring apparatus such as a particular illuminating device for the auto-scoring, for example.

A CM or an image video may be televised previously to the play, and specific pictures may be provided during the game, for example, at the time of a strike. Also, the employment of an AD (analog/digital) converter circuit allows an easy display of a reduced image of the pins simultaneously with the other image showing the score by the use of the open space thereof.

Pin number can be extracted as well as the number of the remaining pins, which makes it possible to analyze the tendency of the game of the bowler such as the probability for the positions of the remaining pins.

The score may be transmitted to other host computers to automatically display the ranking in the tournament and the like. The use of the magnetic cards for the customer management ensures automatic transmission of data such as name including chinese characters and handicaps to the auto-scoring apparatus, which facilitates the procedure required to start the game.

The present invention is not confined to the above described embodiment, but may be otherwise and optionally embodied or practiced without departing from the spirit or essential character thereof.

What is claimed is:

1. A bowling apparatus with an automatic detecting function for remaining pins, comprising a television camera for photographing the state in which all of ten pins stand from the upper front to obtain image data therefrom for specific points corresponding to predetermined positions of the pins serving as reference image data for each of the pins, said television camera being also used for photographing the state of the remaining pins after the first bowl to compare image data obtained therefrom with said reference image data, to thereby determine the presence or absence of pins which are objects to be measured for an automatic scoring, wherein image data measurement points in the first pin are provided at both sides of the head of the first pin which are not allowed to coincide with the image of the fifth pin.

* * * * *